United States Patent [19]

Hickman et al.

[11] 4,256,294

[45] Mar. 17, 1981

[54] PORTABLE WORKBENCH

[75] Inventors: Ronald P. Hickman; Alan F. Styman, both of Jersey, Channel Islands

[73] Assignee: Inventec Licensing B.V., De Leersum, Netherlands

[21] Appl. No.: 39,297

[22] Filed: May 15, 1979

[30] Foreign Application Priority Data

May 25, 1978 [GB] United Kingdom ..... 22529/78

[51] Int. Cl.[3] ..... B25B 1/22

[52] U.S. Cl. ..... 269/16; 144/285; 206/349; 269/139; 269/219; 269/901

[58] Field of Search ..... 144/285; 108/33, 34; 206/460, 813, 523, 349; 269/321 CF, 139, 16, 219–220

[56] References Cited

U.S. PATENT DOCUMENTS

| | | | |
|---|---|---|---|
| 694,312 | 2/1902 | Barber | 144/285 |
| 1,063,046 | 5/1913 | Lathrop | 144/285 |
| 1,287,657 | 2/1919 | Travers . | |
| 2,011,197 | 8/1935 | Mordt | 144/285 |
| 2,139,293 | 12/1938 | Wallgren . | |
| 2,786,500 | 3/1957 | Unterfranz . | |
| 2,791,251 | 5/1957 | Steele . | |
| 4,073,484 | 2/1978 | Beekenkamp | 269/321 CF |
| 4,155,609 | 5/1979 | Skafte et al. | 269/321 CF |
| 4,162,004 | 7/1979 | Thomas | 206/349 |

FOREIGN PATENT DOCUMENTS

| | | | |
|---|---|---|---|
| 22980 | of 1905 | United Kingdom | 144/285 |
| 24043 | of 1905 | United Kingdom | 144/285 |
| 160812 | 10/1921 | United Kingdom | 144/285 |

*Primary Examiner*—Robert C. Watson

*Attorney, Agent, or Firm*—Brumbaugh, Graves, Donohue & Raymond

[57] ABSTRACT

In the illustrative embodiment of the invention disclosed, a portable workbench and carrying case therefor includes front and rear vise beams, a pair of independently operable vise screw rods for moving the vise beams relatively towards and away from one another, and a six-sided case that is foldable between a closed, carrying condition in which it encloses the workbench and an open, use position in which it is adapted to overlie a table-top and cooperate therewith to facilitate use of the workbench.

17 Claims, 5 Drawing Figures

PORTABLE WORKBENCH

BACKGROUND OF THE INVENTION

The present invention relates in general to a portable workbench and pertains in particular to a combined workbench and carrying case which facilitates use of the workbench.

SUMMARY OF THE INVENTION

According to the present invention, a portable workbench and carrying case comprises a twin vise beam workbench including vise operating means operatively connected between the vise beams for moving them relative to one another to clamp a workpiece therebetween and a four to six-sided case having inter-connected front and back sides and one or both of (1) base and top sides and (2) two end sides. The case has a closed, or carrying, condition in which the sides form a box-like structure encircling the workbench, in the case of a four-sided case, and fully enclosing the workbench, in the case of a six-sided case, and an open, or use, condition in which the workbench is capable of being used while resting on a table top with the case back side being positioned beneath the vise beams and some or all of the other case sides being folded out to positions in which they lie either in the same plane as the back side or below that plane, i.e., the table top. The case back side is preferably generally rectangular, and the two end sides, the top side and the base side, where provided, are foldingly connected to respective ones of the four edges of the back side. Structure is provided on the case back and the workbench to hold the workbench in place on the back side.

At least one of the end sides, the top side, or the base side preferably is foldable with respect to the back side through at least 180° relative to its position in the closed condition of the case to lie vertically downwards in the open condition of the case.

The case front side may comprise a tool box which is conveniently foam filled to define tool receiving recesses. The front side may be connected to an edge of either of the end sides or to an edge of the base side, and preferably is interchangeably connected thereto by releasable fasteners. Stud fasteners are preferably used for this purpose.

The tool box may have a separate lid which is bodily removable from the box and thereafter connectable to an edge of one of the end sides or the base side (to which the box is not at that time connected) so as to lie flat on the table top to form a work surface.

In order to permit the end sides of the vise beams to overhang an edge of the table top, so as to have a workpiece clamped therebetween which extends below the table top, the back side may be formed along an edge thereof with a flat portion that is arranged to fold vertically downward in the open condition of the case. Likewise, a flap portion of the back side, at an edge thereof which merges with the top, may be arranged to fold vertically downward in the open condition to permit the handles of the vise operating means to overhang an edge of the table top.

If desired, a carrying handle may be provided on the case or the workbench itself, with appropriate slots being formed in the case parts that overlie the handle in the closed condition of the case to allow access to the handle.

BRIEF DESCRIPTION OF THE DRAWINGS

Further objects and advantages of the invention may be appreciated from the following description of an exemplary embodiment thereof, taken in conjunction with the accompanying drawings, in which.

DETAILED DESCRIPTION

Figure 1:
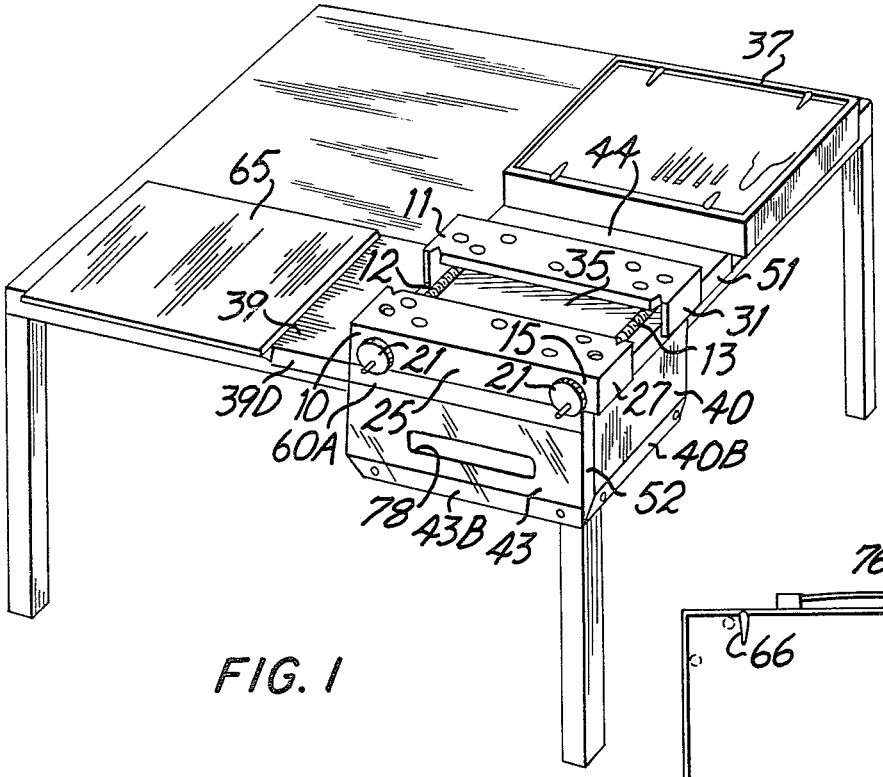
FIG. 1 is a perspective view of a twin vise beam workbench in an operative or use condition on a table top with the carrying case in an open condition facilitating use of the workbench.

In the illustrative embodiment of the invention shown in the drawings, a combined workbench and carrying case incorporates a twin vise beam workbench having a front beam 10 which is stationary and a movable rear beam 11, the beams being interconnected by a pair of screw rods 12 and 13 having handles 21. The screw rods are journalled in cylindrical sleeves 17 (see FIG. 4) which are secured to the underside of the front beam 10 for rotation about respective vertical pivotal connections. The journalling of the screw rods in the sleeves 17 is such that the rods cannot move axially with respect to the front beam 10. Beneath the rear beam 11, each screw rod 12, 13 passes through a threaded nut 19 (see FIG. 4) which is secured to the underside of the rear beam 11 by a vertical pivotal connection that enables independent operation of the vise screw rods 12 and 13 by means of the handles 21 at their front ends, thereby permitting the rear beam 11 to be angled relative to the front beam 10.

Alternatively, the connections of the screw rods to the front and rear beams may be constructed in the manner disclosed in U.S. Pat. No. 3,615,087, the pertinent portions of which are incorporated herein by reference.

As shown in FIG. 1, the front beam 10 has a front vertical wall 25 and end walls 27 which space the upper surface of the beam above the table top. In a similar manner, the rear beam 11 has a rear wall 29 (see FIG. 4) and end walls 31. Preferably the upper surfaces of the front and rear beams lie in substantially the same plane.

Figure 2:
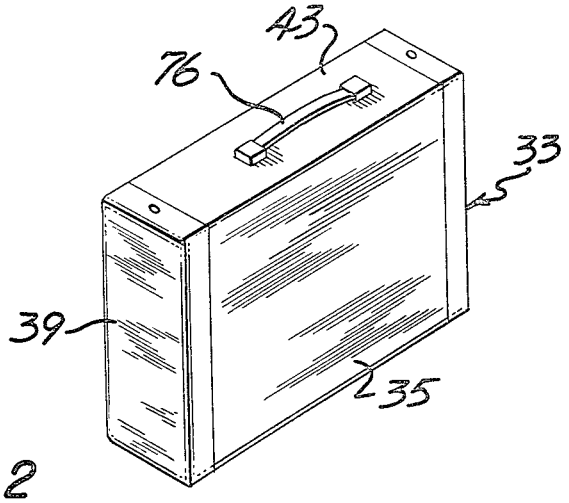
FIG. 2 is a perspective view of the carrying case in a closed or carrying condition.

The carrying case for the unit, which is generally indicated at 33 in FIG. 2, is of box-like structure having six sides that include a back 35, a front 37 in the form of a tool box (see FIG. 1) which is described in more detail later, a pair of ends 39 and 40, a top 43 and a base 44. As best seen in FIG. 5, the back 35 is preferably generally rectangular and the ends 39 and 40, the top 43 and the base 44 all comprise flaps adapted to fold with respect to the back 35 about fold lines 39A, 40A, 43A and 44A, respectively. The base 44 has a long edge flap 44B having a pair of press stud fasteners 44C by which the tool box 37 can be secured in the manner depicted in FIGS. 1 and 3–5. The end 39 also has an edge flap 39B having a pair of like fasteners 39C by which the tool box 37 can be secured in an alternative position by means of stud fasteners 37A formed on the tool box as shown in FIG.

Figure 3:
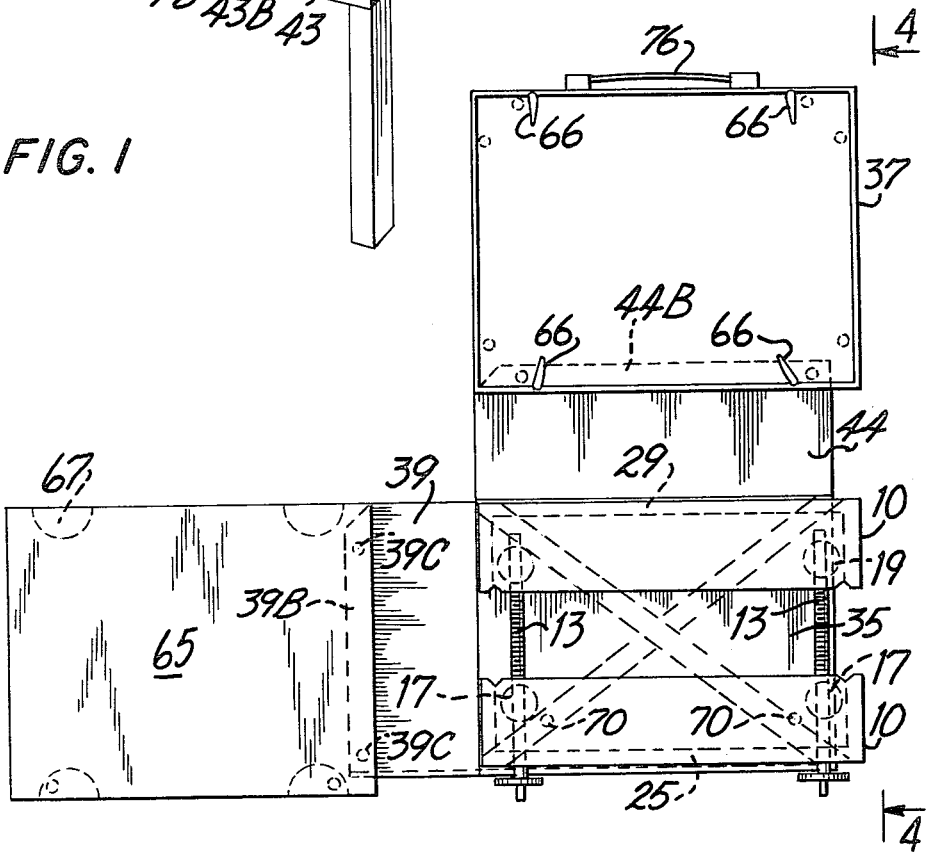
FIG. 3 is a plan view of the combined workbench and carrying case unit in the open or use condition.

5. The other end 40 of the carrying case has an edge flap 40B that is also provided with press stud fasteners 40C arranged to cooperate with the fasteners 37A of the tool box 37 when the box acts as a lid or front and the end 40 is folded upwards about the fold line 40A. Similarly, when the end 39 is folded upwards, the fasteners 39C cooperate with fasteners 37B on the box 37. Finally, the box has two further fasteners 37C along its fourth edge to cooperate with fasteners 43C on a flap 43B along the longitudinal edge of the top 43. It will be understood that the fasteners 37A, 37B and 37C on the box 37 are located on the underside of the box as seen in FIGS. 1 and 3.

It is to be observed that the back 35, the base 44 and the top 43 have aligned narrow flaps 50, 51 and 52, respectively, the flap 50 in effect forming part of the base 35 and lying between it and the fold line 40A. The flap 50 has a fold line 50A to permit the flap 50 and the end 40 to fold downwards to a vertical position as shown in FIG. 1. The flap 51, which is linked to the flap 50 along the fold line 44A, is also folded down vertically, and this allows the right hand ends of the beams 10 and 11 to overhang the table-top as shown in FIGS. 1 and 3 so that a workpiece can be clamped vertically between the ends of the beams and yet extend down below the table top.

When the combined workbench and carrying case is in an operative or use position adjacent a corner of a table, as shown in FIG. 1, the top 43 extends down vertically along the front of the table and at this time fasteners 52A on the flap 52 of the top 43 (see FIG. 5) are adapted to cooperate with fasteners 40D on the end 40 which extends down along the side of the table. The end 40 has a further flap 40E which extends around the front of the table and underlies the top 43 when the fasteners 52A and 40D cooperate with one another. This arrangement of the carrying case holds the case 33 against movement away from the table corner.

The back 35 along its edge adjacent the top 43 has a further narrow flap 60 having a fold line 60A with the remainder of the back 35. The flap 60, together with the top 43, hangs vertically in front of the table in the operative condition of FIG. 1. The end 39 also has a short flap 39D aligned with the flap 60 and which also extends down vertically in FIG. 1 along the front of the table.

With reference now to FIGS. 1 and 3, the tool box 37 has a loose lid 65 which can be retained in position on the box to secure the tools in a foam lining to the box 37 by a means of four clips 66. The clips 66 are pivotally attached to the tool box 37 so as to be movable into and out of cooperating recesses 67 in the lid 65 (see FIG. 1). The lid 65 also has fasteners arranged to cooperate with the fasteners 39C of the end 39 as shown in FIGS. 1 and 3, or the fasteners 44C of the base 44 if the lid 65 and the tool box 37 are interchanged.

Figure 4:
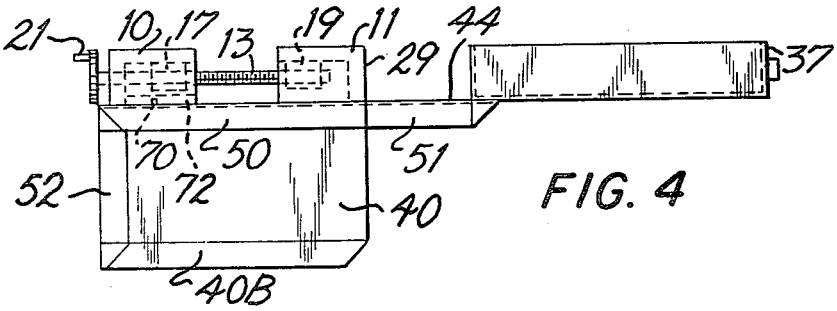
FIG. 4 is a side elevational view of the embodiment of FIG. 3 taken along the line 4—4 and looking in the direction of the arrows.
Figure 5:
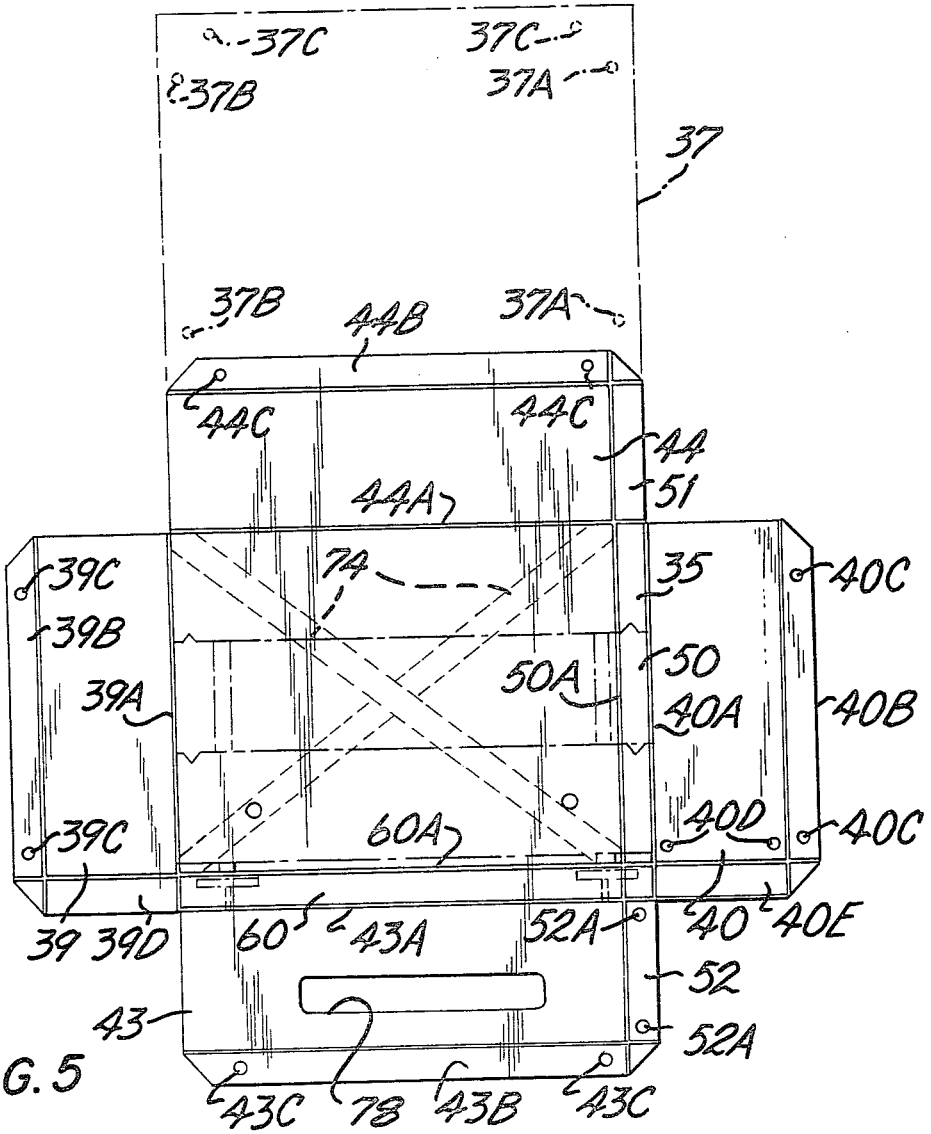
FIG. 5 is a plan view of the carrying case opened out, with the workbench shown in phantom for clarity of illustration.

In order to locate the workbench formed by the two vise bams 10 and 11 with respect to the case, the back 35 of the case has a pair of upstanding studs 70, shown in FIGS. 3 and 4, which cooperate with apertures formed in a horizontal integral portion 72 of the front bar 10 (see FIG. 4).

To aid in ensuring a good trip between the back 35 and table top, a pair of friction strips 74 are positioned diagonally on the under surface of the back 35. These may be omitted if the material from which the case is made has good friction grip qualities.

As an aid in carrying the case 33, a handle 76 may be provided on one side of the tool box 37 (see FIGS. 2 and 3) with a matching slot 78 being formed in the top 43 to permit the handle 76 to protrude through the top when the case is closed up. If desired, the handle could instead be attached to one of the vise beams 10 and 11, with an appropriately located slot or slots then being provided in the part or parts of the case which overlay the handle when the case is closed.

It will be understood that the foregoing embodiment is susceptible of variation and modification without departing from the inventive concepts embodied therein. For example, the construction of the workbench and carrying case shown in the drawings is designed for use by a right-handed person. It will be appreciated, however, that a left-handed version could equally be produced or, alternatively, the unit could be adapted for use by either left-handed or right-handed users. Also, if desired either one or both of the base and top sides 44 and 43, respectively, or one or both of the two end sides 39 and 40 could be omitted, the case then taking the form of a four or five-sided box-like structure which encircles the workbench in the front-to-rear direction or in the end-to-end direction. All such variations and modifications, therefore, are intended to be included within the spirit and scope of the appended claims.

We claim:

1. A portable workbench and carrying case, comprising:

a workbench including (1) front and rear vise beams having facing surfaces and having upper surfaces which together define the working surface of the workbench and (2) vise operating means operatively connected between the front and rear vise beams for moving them relative to one another in the front-to-rear direction to enable the gripping of a workpiece between the facing surfaces thereof;

a carrying case comprising at least four sides, including a front side, a back side and at least two additional sides comprised of (1) a base side and a top side or (2) two end sides, means foldably interconnecting said at least four sides for movement thereof between a closed condition, in which said at least four sides form a box-like structure encircling the workbench for carrying, and an open condition adapted for use on a table-top, in which the case back side rests on the table-top, the workbench is supported on the upper surface of the case back side and the other case sides are folded out from said closed condition to positions in which said workbench is uncovered such that said work surface and said vise operating means are accessible for use, said foldably interconnecting means including means for connecting at least one other side to said back side so that said other side is capable of being folded out to a position in which it extends downwards adjacent to an edge of said table-top to coact therewith to restrain said workbench and carrying case in place on the table top;

means on said workbench and said case for mounting said workbench on said case back side so that at least one of the vise beams is held againt movement relative to the case in the plane of the case back side.

2. The portable workbench and carrying case of claim 1, in which the case includes both of said base and top sides and said two end sides, said back side is generally rectangular, and the two end sides, the top side and the base side are foldably connected one to each of the four edges of the back side.

3. The portable workbench and carrying case of claim 2, in which said at least one other side comprises one of the end sides, the top side and the base side, and said means for foldably connecting said at least one other side to said back side permits said other side to fold with respect to the back side through at least 180° relative to its position in the closed condition to lie vertically downwards in the open condition.

4. The portable workbench and carrying case of claim 1, in which the front side comprises a tool box.

5. The portable workbench and carrying case of claim 4, in which the tool box is foam filled and defines one or more tool holding recesses therein.

6. The portable workbench and carrying case of claim 4, in which the tool box includes a lid and means for releasably attaching the lid to the tool box for bodily removal therefrom, and in which said lid and at least one of said end sides and base side includes coacting means for releasably connecting said lid to an edge of one of the end sides or the base side so as to lie flat on the table top to form a work surface.

7. The portable workbench and carrying case of claim 1, in which said at least two additional sides comprise said two end sides, and said foldably interconnecting means includes means for releasably connecting said front side to an edge of at least one of the end sides.

8. The portable workbench and carrying case of claims 2, in which said foldably interconnecting means includes means for interchangeably connecting the front side to an edge of either end side or an edge of the base.

9. The portable workbench and carrying case of claim 8, in which the front side is connected to said edge by stud fasteners.

10. The portable workbench and carrying case of claim 1, further including a carrying handle secured to a side of said carrying case and accessible from outside carrying case when said case is in the closed condition.

11. The portable workbench and carrying case of claim 1, in which the back side is formed along an end edge thereof with a flap portion, said flap portion being arranged to fold vertically downward in the open condition of the case to permit the ends of the vise beams to overhand an edge of the table top to enable a workpiece to be clamped therebetween which extends below the table top.

12. The portable workbench and carrying case of claim 1, in which the vise operating means includes (1) a pair of vise screws spaced lengthwise of said beams and extending from front-to-rear between the vise beams and (2) an operating handle on each vise screw located to the front of said front vise beam; and the case includes said base and top sides and said back side is formed along an edge thereof with a flap portion which is foldably interconnected with the top side, said flap portion being arranged to fold vertically downward in the open condition of the case to permit the handles of the vise operating means to overhang an edge of the table top.

13. The portable workbench and carrying case of claim 1, further including a carrying handle secured to said workbench and accessible from outside said carrying case when said case is in the closed condition.

14. The portable workbench and carrying case of claim 4, in which said foldably interconnecting means includes means for permitting said tool box to fold out to a position in which it lies flat on the table top when the case is in the open condition.

15. The portable workbench and carrying case of claim 1, in which said at least two sides comprise said base and top sides, and said foldably interconnecting means includes means for releasably connecting said front side to an edge of at least one of said base side and said top side.

16. The portable workbench and carrying case of claim 2, in which said means for foldably interconnecting said front side and at least one end side to said back side permits said front side and said at least one end side to fold out in the open condition to positions in which they extend vertically downwards adjacent to respective intersecting edges of said table-top, and in which said foldably interconnecting means further includes means for releasably securing adjacent vertically-extending edges of said front side and said at least one end side together so as to overlap a corner of said table-top.

17. The portable workbench and carrying case of claim 1, further including means for releasably securing said carrying case in the closed condition.

* * * * *

UNITED STATES PATENT AND TRADEMARK OFFICE

CERTIFICATE OF CORRECTION

PATENT NO. : 4,256,294

DATED : March 17, 1981

INVENTOR(S) : Ronald P. Hickman et al.

It is certified that error appears in the above—identified patent and that said Letters Patent is hereby corrected as shown below:

First page, Item 56 (References Cited), under "U. S. PATENT DOCUMENTS" delete "1,287,657 2/1919 Travers" and under "FOREIGN PATENT DOCUMENTS" insert --1,287,657 of 1962 France--;

Column 5, line 30, "claims 2" should read --claim 2--;

Column 5, line 40, before "carrying" insert --said--;

Column 5, line 46, "overhand" should read --overhang--.

Signed and Sealed this

*Fourteenth* Day of *July 1981*

[SEAL]

*Attest:*

GERALD J. MOSSINGHOFF

*Attesting Officer*

*Commissioner of Patents and Trademarks*